US008465134B2

(12) United States Patent
Watanabe

(10) Patent No.: US 8,465,134 B2
(45) Date of Patent: Jun. 18, 2013

(54) IMAGE FORMING APPARATUS

(75) Inventor: Tatsuro Watanabe, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 385 days.

(21) Appl. No.: 12/878,310

(22) Filed: Sep. 9, 2010

(65) Prior Publication Data

US 2011/0063385 A1 Mar. 17, 2011

(30) Foreign Application Priority Data

Sep. 15, 2009 (JP) ..... 2009-213784

(51) Int. Cl.
*B41J 2/175* (2006.01)

(52) U.S. Cl.
USPC ..... 347/86

(58) Field of Classification Search
USPC ..... 347/85, 86, 87; 222/95
See application file for complete search history.

(56) References Cited

U.S. PATENT DOCUMENTS

| | | | | |
|---|---|---|---|---|
| 6,145,970 | A * | 11/2000 | Sasaki et al. | 347/85 |
| 6,378,971 | B1 | 4/2002 | Tamura et al. | |
| 6,854,836 | B2 * | 2/2005 | Ishinaga et al. | 347/85 |
| 7,152,965 | B2 * | 12/2006 | Ishizawa et al. | 347/86 |
| 8,016,376 | B2 * | 9/2011 | Sugahara | 347/7 |
| 8,083,101 | B2 * | 12/2011 | Kimura | 222/95 |
| 2006/0139420 | A1 | 6/2006 | Muranaka et al. | |
| 2009/0169222 | A1 | 7/2009 | Watanabe | |

FOREIGN PATENT DOCUMENTS

| | | |
|---|---|---|
| JP | 2001-105619 | 4/2001 |
| JP | 3919734 | 2/2007 |

* cited by examiner

*Primary Examiner* — Anh T. N. Vo
(74) *Attorney, Agent, or Firm* — Cooper & Dunham LLP

(57) ABSTRACT

A liquid container includes a liquid containing member configured to contain liquid to be supplied to a recording head for jetting liquid droplets, the liquid containing member having flexibility; and an outer container configured to accommodate the liquid containing member. The liquid containing member includes a liquid supply opening, and a side of the liquid containing member opposite to the liquid supply opening is fixed to an inner surface of the outer container.

4 Claims, 14 Drawing Sheets

IMAGE FORMING APPARATUS

BACKGROUND OF THE INVENTION

1. Field of the Invention

The present invention relates to liquid containers and image forming apparatuses, and more particularly to an image forming apparatus having recording heads for jetting liquid droplets and a liquid container for containing liquid to be supplied to the recording heads.

2. Description of the Related Art

There are image forming apparatuses such as printers, fax machines, copiers, plotters, and multifunction peripherals including functions of these devices. An inkjet recording apparatus is known as an example of an image forming apparatus of a liquid jet recording method using recording heads for jetting ink droplets. Such an image forming apparatus of a liquid jet recording method forms images (record and print may be used synonymously as form) by jetting ink droplets from recording heads onto a conveyed sheet (the sheet is not limited to a paper sheet; the sheet may be any sheet onto which ink droplets or other types of liquid can adhere such as an OHP transparency film; the sheet may also be referred to as a recording medium, a recording sheet, etc.). There are several types of image forming apparatuses of a liquid jet recording method. One example is a serial type image forming apparatus that forms images by jetting liquid droplets while moving the recording heads in a main scanning direction. Another example is a line type image forming apparatus that uses line type heads to form images by jetting liquid droplets while the recording heads do not move.

In the present application, an image forming apparatus of a liquid jet recording method means an apparatus that forms images by jetting liquid onto a medium such as paper, thread, fiber, cloth, leather, metal, plastic, glass, wood, ceramics, etc. Forming images on a medium means forming images having meaning (such as characters and figures) and forming images without any meaning (such as patterns, e.g., merely jetting liquid droplets onto a medium). Ink is not limited to what is generally referred to as ink; ink refers to any kind of liquid that can be used for forming images, such as recording liquid and fixing process liquid; examples of ink are DNA samples, resist, and pattern material.

There is demand for an image forming apparatus of a liquid jet recording method with high image forming throughput, i.e., high image forming speed. Accordingly, there is known a method of supplying ink from a large capacity ink cartridge in the apparatus main unit (main tank), to a sub tank (also referred to as a head tank or a buffer tank) via a tube.

A liquid container used as the main tank or the ink cartridge is, for example, an ink cartridge including an ink pack and a hard case for accommodating the ink pack. Plural ribs are provided inside the hard case for holding the periphery of the ink pack. The ink pack is held to substantially maintain a certain shape, so that it does not deform by a large amount even when shaken or dropped. Accordingly, the ink pack is prevented from being damaged (see patent document 1).

Patent Document 1: Japanese Laid-Open Patent Application No. 2001-105619

For example, an ink cartridge includes a flexible ink pack containing ink and an outer container such as a hard case accommodating the ink pack. The ink is supplied from the ink cartridge to the main unit of an image forming apparatus. The ink pack gradually deflates as the ink is consumed. When the ink pack finally becomes flat, if the ink pack is not neatly deflated, a large amount of ink may remain in the ink pack without being used. Accordingly, a large amount of ink may be left over.

SUMMARY OF THE INVENTION

The present invention provides an image forming apparatus and a liquid container, in which one or more of the above-described disadvantages are eliminated.

A preferred embodiment of the present invention provides an image forming apparatus and a liquid container with which the amount of leftover liquid can be reduced.

According to an aspect of the present invention, there is provided a liquid container including a liquid containing member configured to contain liquid to be supplied to a recording head for jetting liquid droplets, the liquid containing member having flexibility; and an outer container configured to accommodate the liquid containing member, wherein the liquid containing member includes a liquid supply opening, and a side of the liquid containing member opposite to the liquid supply opening is fixed to at least one inner surface of the outer container.

According to one embodiment of the present invention, an image forming apparatus and a liquid container are provided, in which a liquid containing member deflates substantially evenly as the liquid is consumed, and therefore the amount of leftover liquid can be reduced, and the liquid can be consumed without waste.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of embodiments of the present invention.

Figure 1:
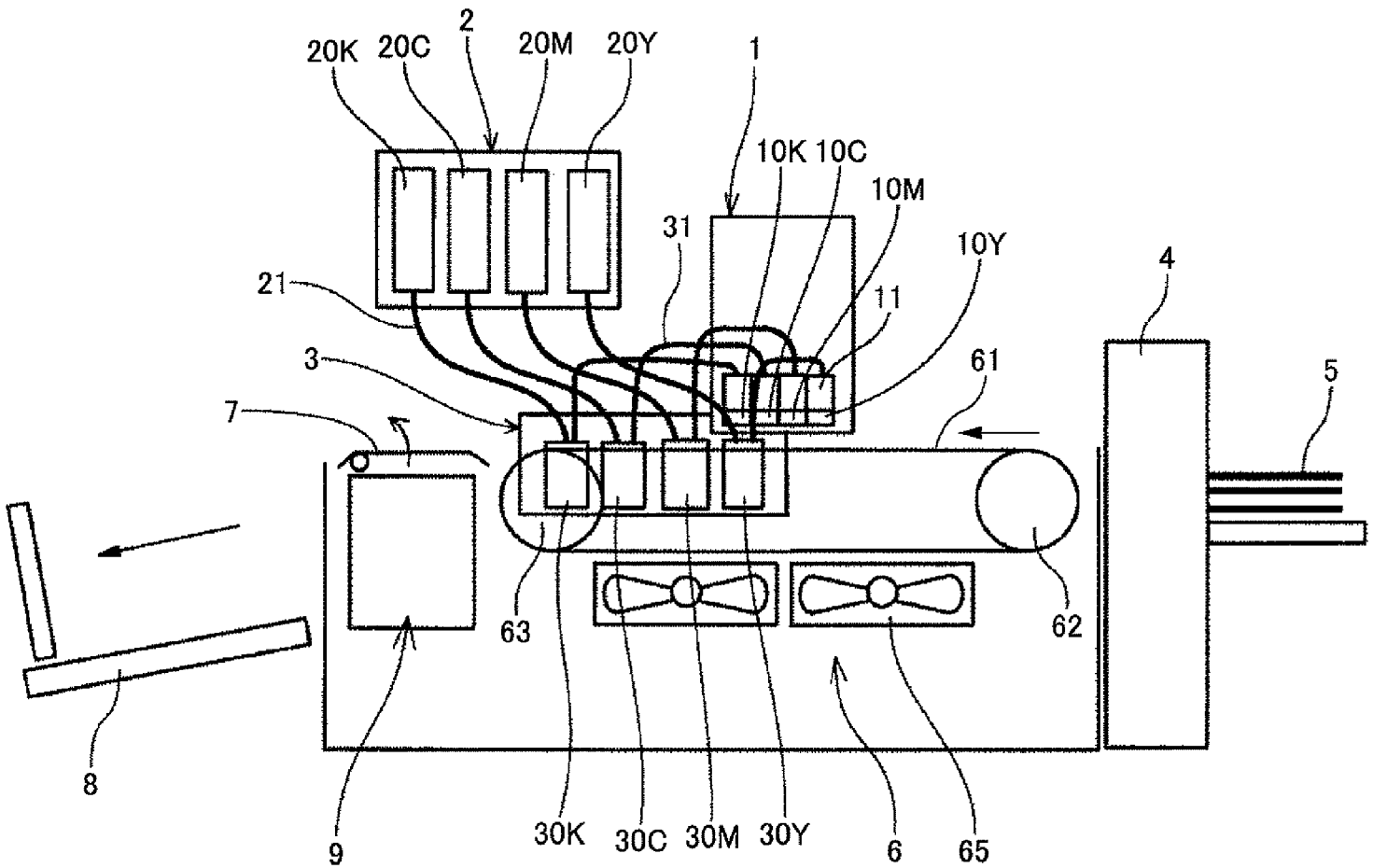
FIG. 1 is a schematic side view of the overall configuration of an image forming apparatus according to a first embodiment of the present invention.

A description is given of an image forming apparatus according to a first embodiment of the present invention, with reference to FIG. 1. FIG. 1 is a schematic side view of the overall configuration of the image forming apparatus according to the first embodiment of the present invention.

The image forming apparatus includes plural recording heads 10Y, 10M, 10C, and 10K for jetting liquid ink having colors of yellow (Y), magenta (M), cyan (C), and black (K), respectively (hereinafter, the alphabetical letters Y, M, C, and K accompanying the reference numerals may be omitted when the color is not distinguished; the same applies to other elements). The recording heads 10Y, 10M, 10C, and 10K are integrally held in a head holding member (not shown) that is accommodated in a head unit 1. The head unit 1 is movable in the sheet feeding direction.

Figure 2:
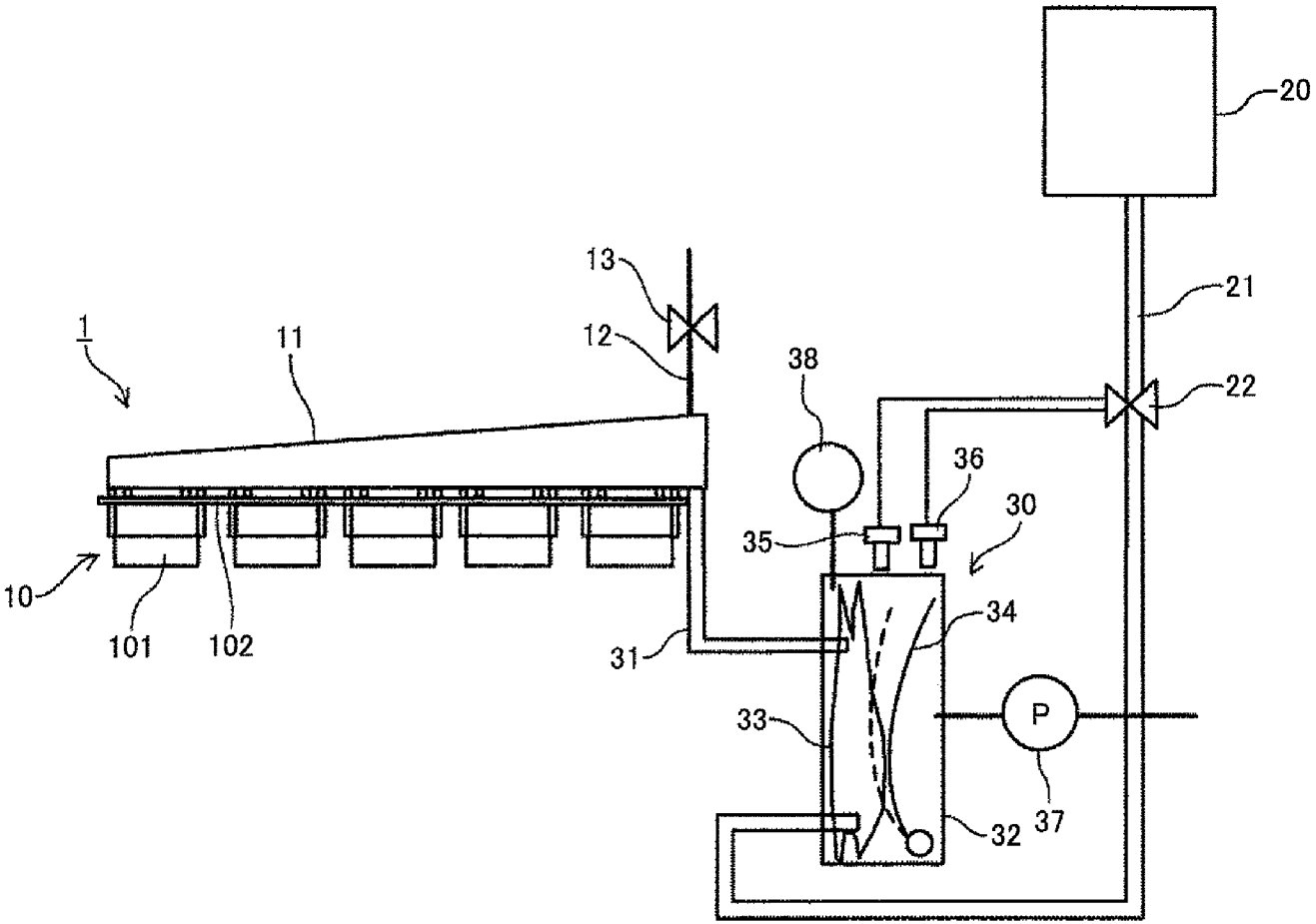
FIG. 2 is for describing an ink supplying system of the image forming apparatus shown in FIG. 1.

Each of the recording heads 10Y, 10M, 10C, and 10K has the following configuration, as illustrated in FIG. 2. Specifically, the recording head 10 includes plural liquid jetting heads 101 arranged zigzag in two rows on a base member 102. The recording head 10 also includes a distributor 11 for distributing ink to the liquid jetting heads 101.

The liquid jetting heads 101 and the distributor 11 are integrally provided in the recording head 10 (integrally provided means being directly connected or connected via a tube).

An ink supplying device is for supplying ink having the respective colors to the recording heads 10 of the head unit 1. The ink supplying device includes a main tank unit 2 and a sub tank unit 3. The main tank unit 2 includes replaceable main tanks 20 (hereinafter, also referred to as "ink cartridges 20") containing ink having the respective colors. The sub tank unit 3 includes sub tanks 30 that receive ink from the main tanks 20 and that supply ink to the recording heads 10. A water head difference is provided between the sub tanks 30 of the sub tank unit 3 and the recording heads 10 of the head unit 1, so that the recording heads 10 are caused to generate the required negative pressure.

A sheet conveying mechanism 6 is disposed underneath the head unit 1. The sheet conveying mechanism 6 is for conveying a sheet 5 in such a manner as to face the head unit 1. The sheet 5 is fed from a sheet feeding device 4. The sheet conveying mechanism 6 includes the following elements. A conveying belt 61 is for conveying the sheet 5 that is adhering to the conveying belt 61. The conveying belt 61 is perforated with plural suction holes. The conveying belt 61 is wound around conveying rollers 62 and 63. A platen member (not shown) is for keeping the conveying belt 61 appropriately flat. Suction fans 65 are for suctioning air through the suction holes of the conveying belt 61 so that the sheet 5 adheres to the conveying belt 61. The method of causing the sheet 5 to adhere to the conveying belt 61 is not limited to a suction method; the sheet 5 may be caused to adhere to the conveying belt 61 by static electricity or by being pasted onto the conveying belt 61.

A conveying guide plate 7 configured to open and close is disposed at the downstream side of the conveying belt 61, and a sheet eject tray 8 is disposed at the downstream side of the conveying guide plate 7. A cleaning unit 9 used for the maintenance/recovery operation of the recording heads 10 is disposed under the conveying guide plate 7. The cleaning unit 9 includes capping members for capping the nozzle surfaces of the liquid jetting heads 101, a suction pump connected to the capping members, and wiper members for wiping the nozzle surfaces.

In the image forming apparatus, the maintenance/recovery (cleaning) operation of the recording heads 10 is performed as follows. First, the conveying guide plate 7 opens by rotating in a direction indicated by an arrow in FIG. 1. This operation exposes the top side of the cleaning unit 9 disposed under the conveying guide plate 7. Next, the head unit 1 slides to a position above cleaning unit 9, and stops. Subsequently, the nozzle surfaces of the recording heads 10 are capped by the capping members. The ink inside the recording heads 10 is suctioned by the suction pump from the nozzles and through the cap members. When the nozzle suction process (maintenance/recovery operation) has been completed, the head unit 1 returns to the printing position, and the conveying guide plate 7 is closed, so that a printing process can be executed. The maintenance/recovery operation is performed by the head unit 1 at predetermined timings, such as when printing has been consecutively performed on a predetermined number of sheets and then a predetermined period of time has lapsed during which printing is not performed.

Next, a description is given of an ink supplying system of the image forming apparatus with reference to FIG. 2.

The ink supplying system mainly includes the ink cartridges 20, the sub tanks 30, the distributor 11, and the liquid jetting heads 101 of the recording heads 10.

Each sub tank 30 includes a tank case 32 which is an airtight container. The tank case 32 accommodates a sub tank bag 33 that is a flexible bag. A filler 34 is provided inside the tank case 32 for controlling the internal volume. A lower limit sensor 35 and an upper limit sensor 36, which are provided outside the tank case 32, are used for detecting the remaining amount of ink in the tank case 32. Based on the detection information, an ink supplying valve 22 disposed on a supplying path 21 is opened/closed, to supply the ink from the ink cartridge 20 to the sub tank bag 33.

An air pump 37 for applying pressure inside the tank case 32 is connected to the sub tank 30, and air is supplied by the air pump 37 to apply pressure onto the sub tank bag 33. A pressure sensor 38 is used for detecting the pressure inside the tank case 32. Ink is supplied through a supply path 31 from the sub tank bag 33 to the distributor 11 of the recording head 10. This mechanism is used for discharging bubbles that have accumulated inside the distributor 11 through a discharge outlet 12, or when a nozzle maintenance/recovery operation of the liquid jetting heads 101 is performed by a pressure unit.

For example, to discharge bubbles that have accumulated inside the distributor 11, pressure is applied with the air pump 37, and at the same time, a bubble discharge valve 13 opens so that the bubbles are discharged from the discharge outlet 12. To perform the nozzle maintenance/recovery operation, pressure is applied to the inside of the tank case 32 with the air pump 37, so that the ink inside the sub tank bag 33 is sent to the liquid jetting heads 101 and forced outside from the nozzles.

Figure 3:
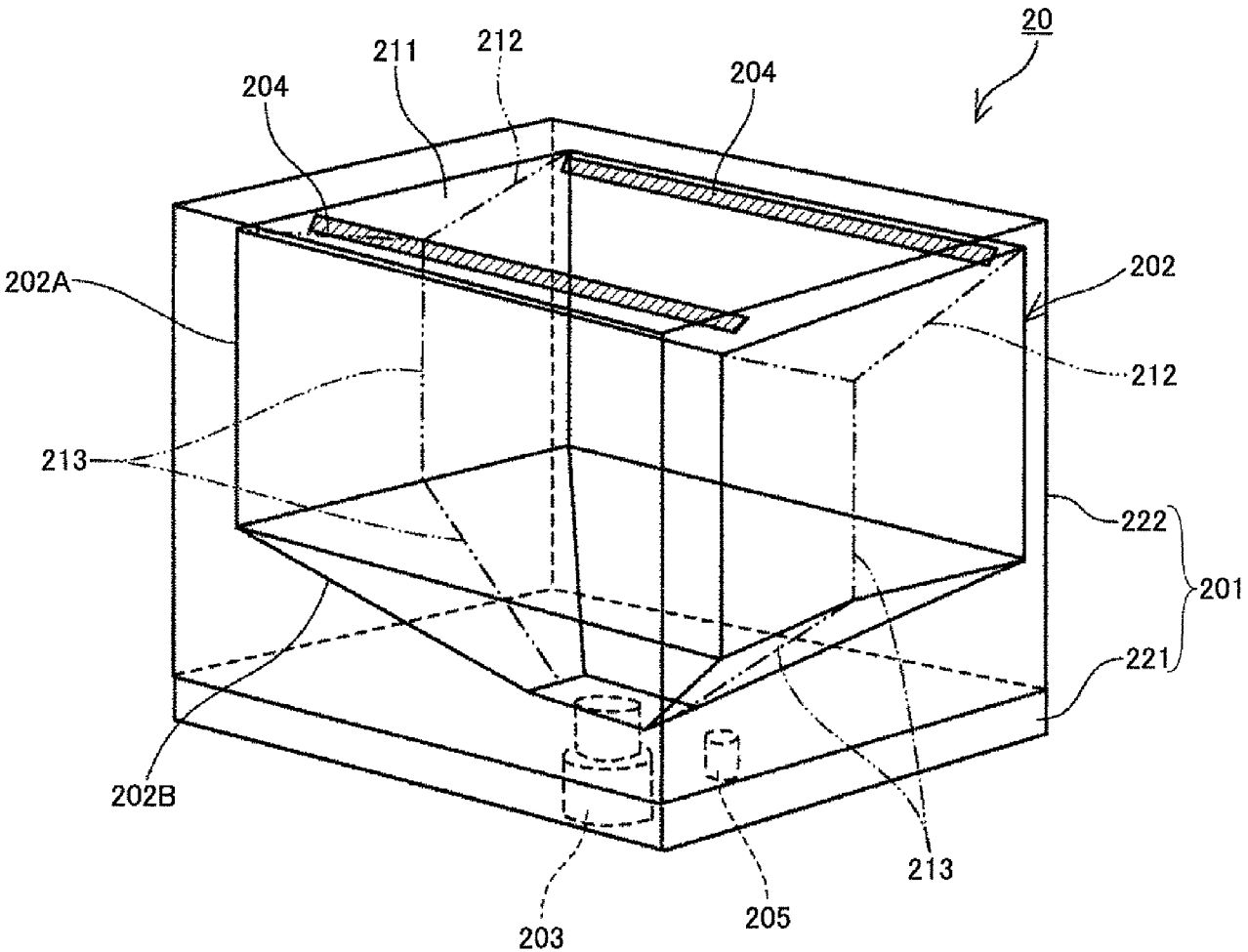
FIG. 3 is a perspective view of an ink cartridge according to the first embodiment of the present invention.
Figure 4:
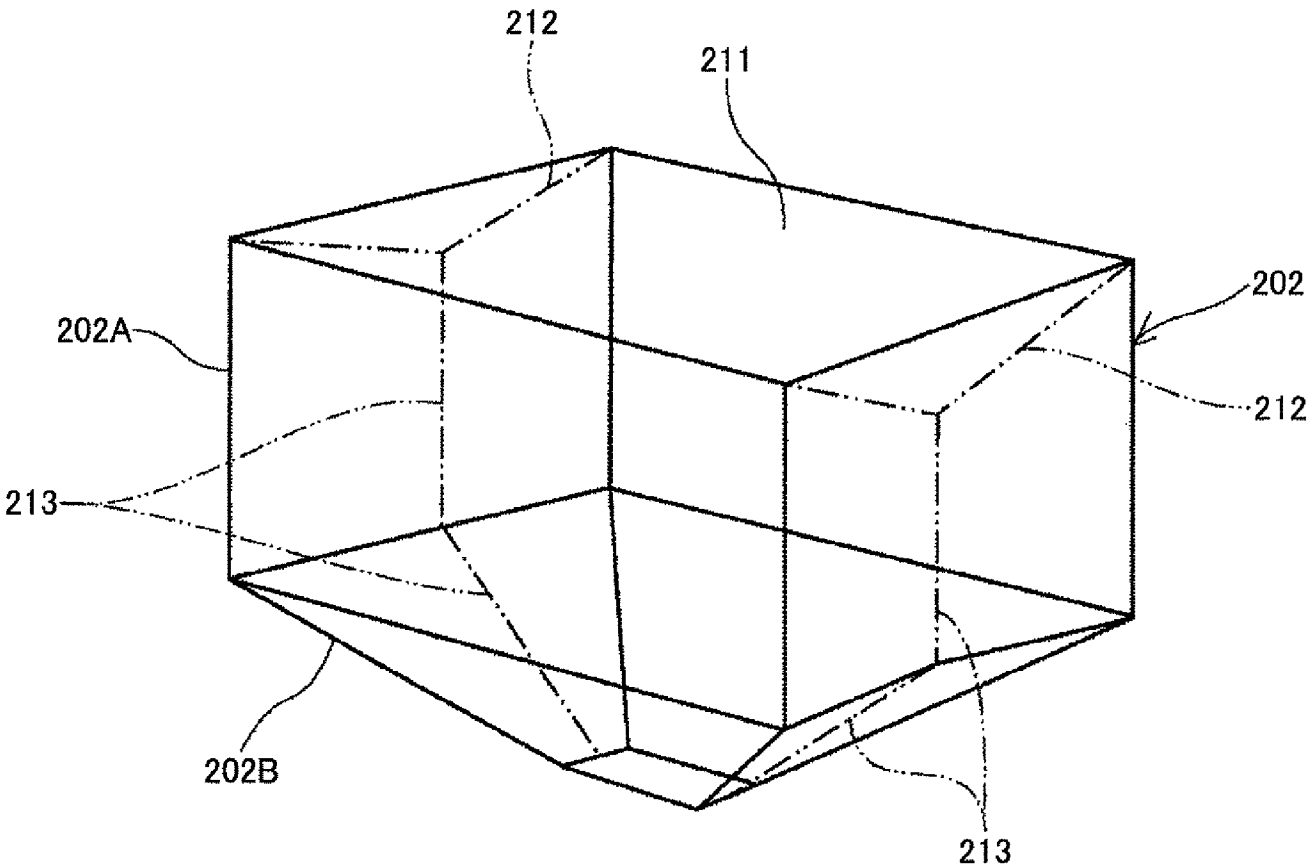
FIG. 4 is a perspective view of an ink pack in the ink cartridge.

Next, a description is given of a liquid container constituting the ink cartridge 20 according to a first embodiment of the present invention, with reference to FIGS. 3 and 4. FIG. 3 is a perspective view of the ink cartridge 20. FIG. 4 is a perspective view of an ink pack in the ink cartridge 20. In FIG. 3, a cartridge case is illustrated in a transparent state.

The ink cartridge 20 includes a cartridge case 201 that is the outer container primarily made of resin; an ink pack 202 (liquid container) that is made of a flexible film (flexible member); an ink supply opening 203 that is a supply opening; and fixing units 204 such as two-sided adhesive tape for fixing the cartridge case 201 and the ink pack 202 to each other.

The cartridge case 201 is an airtight container including a base member 221 and a box type case member 222. The base member 221 is a plate member in which the ink supply opening 203 is formed. The base member 221 is heat-welded to the case member 222 to accommodate the ink pack 202.

The cartridge case 201 has an air supply opening 205 (gas injection opening) through which air enters the cartridge case 201. The air supply opening 205 is provided near the ink supply opening 203 of the ink pack 202. Air is supplied from the air supply opening 205 into the space between the inner walls of cartridge case 201 and the outer walls of the ink pack 202. Accordingly, pressure is applied to the ink pack 202 so that ink is supplied outside from the ink supply opening 203.

The ink pack 202 includes a rectangular parallelepiped part 202A and a quadrangular truncated pyramid part 202B. The ink supply opening 203 is provided at the tip of the quadrangular pyramid part 202B. There are folds 212 and 213 (valley folds) provided on the side surfaces of the ink pack 202. At each side surface, the folds 212 extend from two corners of a plane part 211 of the ink pack 202 toward the center of the ink pack 202. The plane part 211 is on a side of the ink pack 202 opposite to the ink supply opening 203. The fold 213 linearly extends toward the ink supply opening 203 from a position where the two folds 212 meet at the center. The ink pack 202 can be neatly folded because of these folds 212 and 213.

The two edges of the plane part 211 on the side of the ink pack 202 opposite to the ink supply opening 203, are fixed to the inner walls of the cartridge case 201 by the fixing units 204.

Figure 5:
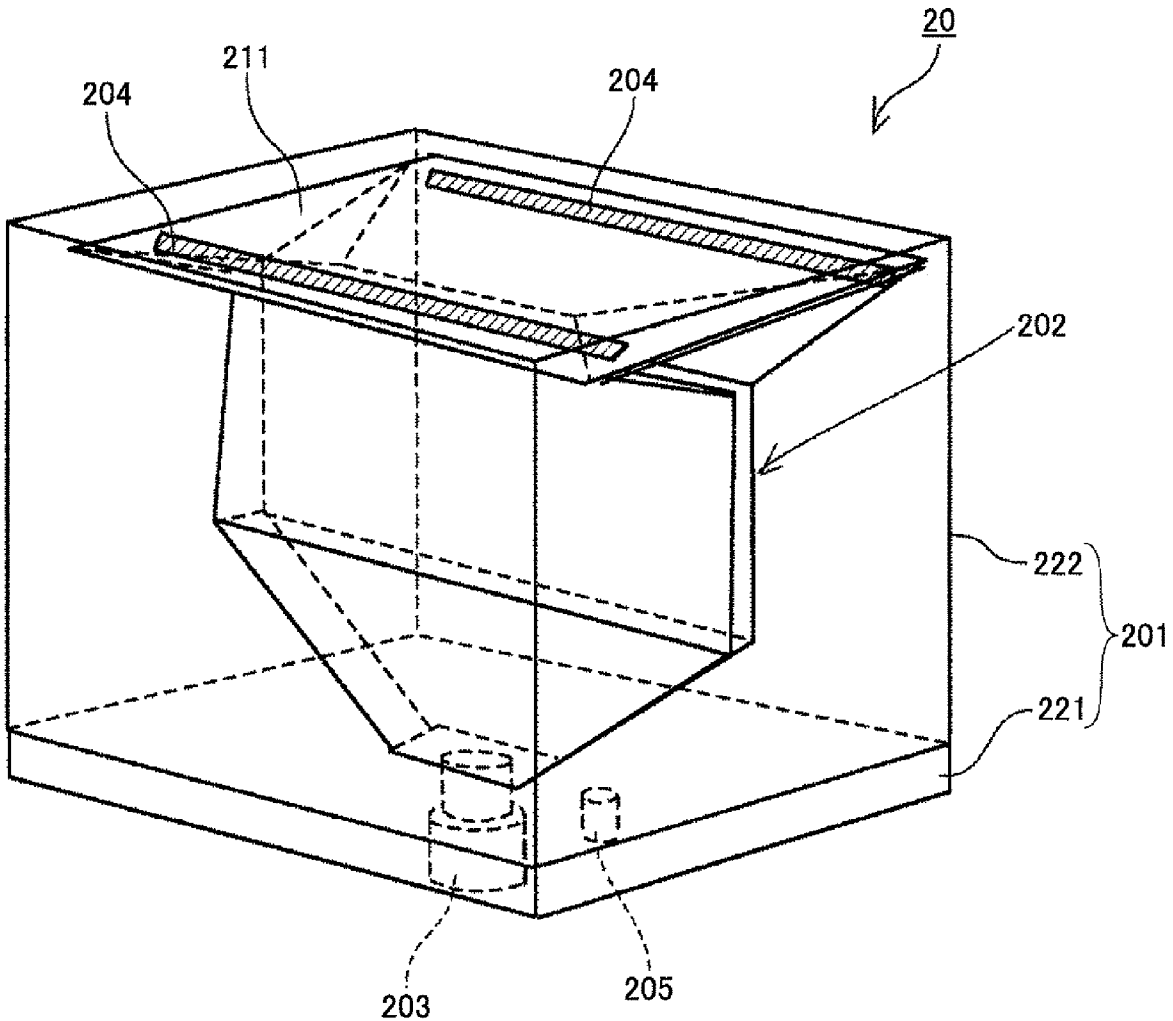
FIG. 5 is a perspective view for describing the function of the ink cartridge.

Functions of the ink cartridge 20 are described with reference to FIGS. 5 through 7.

Figure 6:
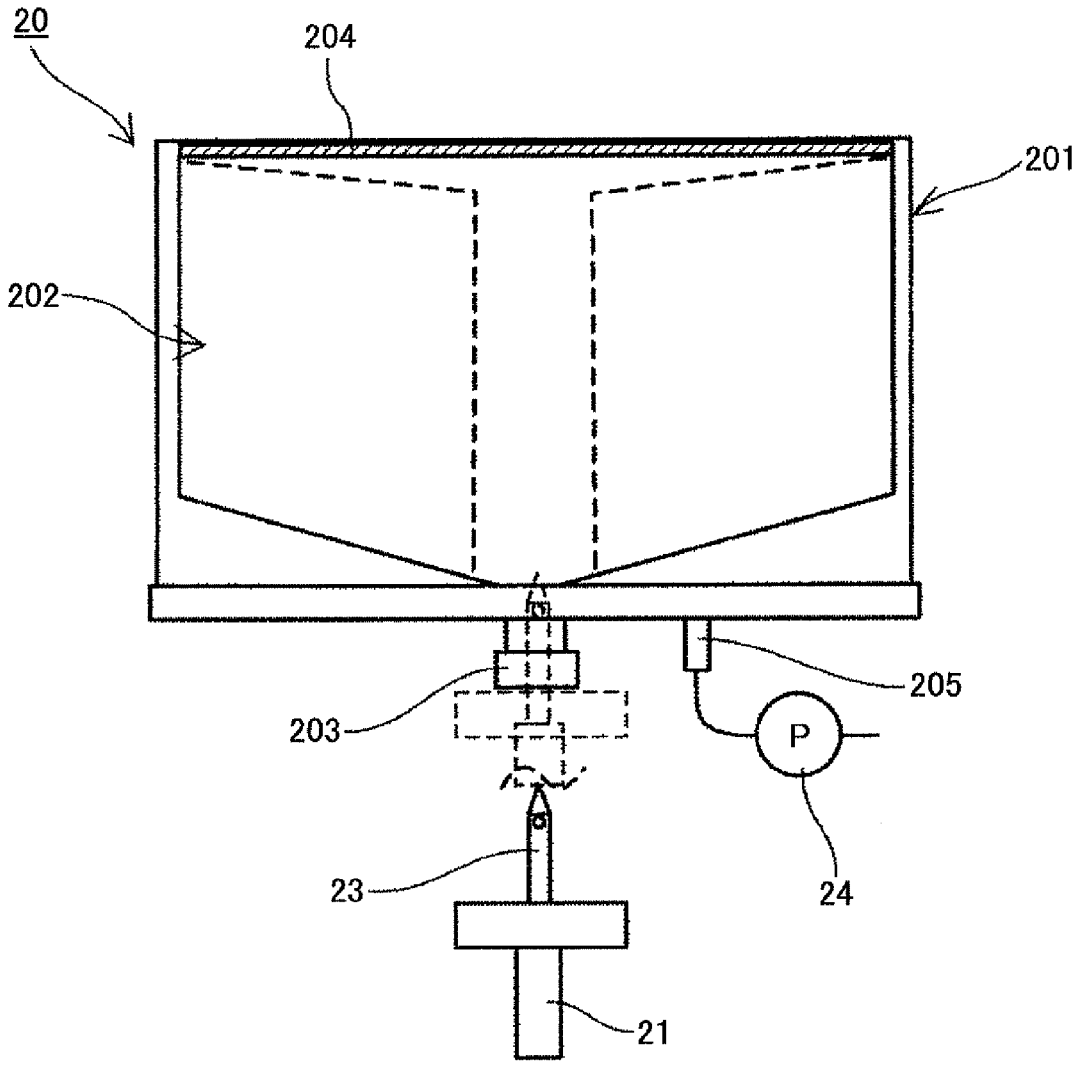
FIG. 6 is a front view for describing the function of the ink cartridge.
Figure 7:
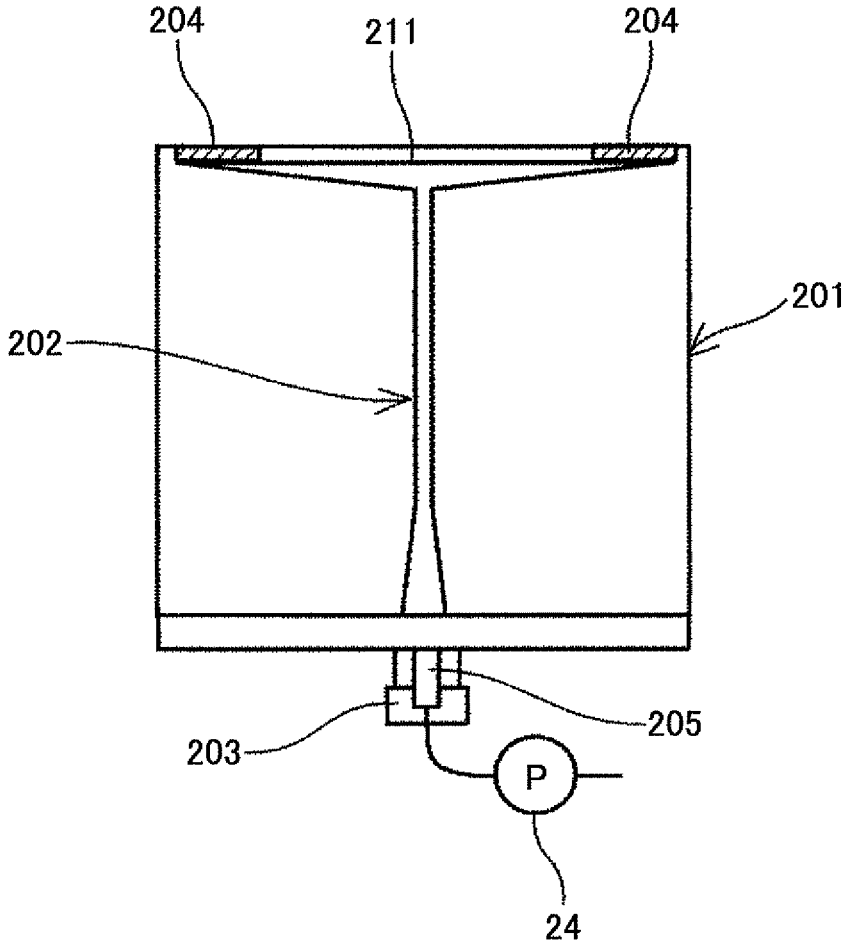
FIG. 7 is a side view for describing the function of the ink cartridge.

When using the ink cartridge 20, as shown in FIG. 6, a hollow nozzle member 23, which is connected to the apparatus main unit via a supply path (tube) 21, is inserted into the ink supply opening 203. Furthermore, a pressure pump 24 is connected to the air supply opening 205. The pressure pump 24 is operated to supply air into the space between the inner walls of the cartridge case 201 and the outer walls of the ink pack 202. Accordingly, pressure is applied to the ink pack 202 and ink is supplied to the sub tank 30 from the ink supply opening 203.

As the ink contained in the ink pack 202 of the ink cartridge 20 is consumed, the ink pack 202 is pressed by the air pressure, and therefore the ink pack 202 deflates.

As described above, the plane part 211, which is on the opposite side of the ink supply opening 203 of the ink pack 202, is fixed to the inner wall of the cartridge case 201 by the fixing units 204 such as two-sided adhesive tape. Therefore, the positional relationship (length) between the ink supply opening 203 of the ink pack 202 and the plane part 211 on the opposite side of the ink supply opening 203 does not change, even when the ink inside the ink pack 202 is consumed.

As a result, even when the ink inside the ink pack 202 is consumed, the ink pack 202 deflates in such a manner that the side surfaces of the ink pack 202 are folded toward the center of the ink pack 202. Therefore, as shown in FIG. 7, the ink pack 202 deflates into a shape like a single film.

Accordingly, the respective ink packs 202 are consistently neatly folded into substantially the same shape, without much variation. Thus, the amount of leftover ink can be reduced, and variations in the amount of leftover ink can be reduced.

As described above, the side opposite to the liquid supply opening of the liquid containing member is fixed to the inner wall of the outer container. Thus, the liquid containing member deflates substantially evenly as the liquid is consumed, and therefore the amount of leftover liquid can be reduced.

Figure 8:
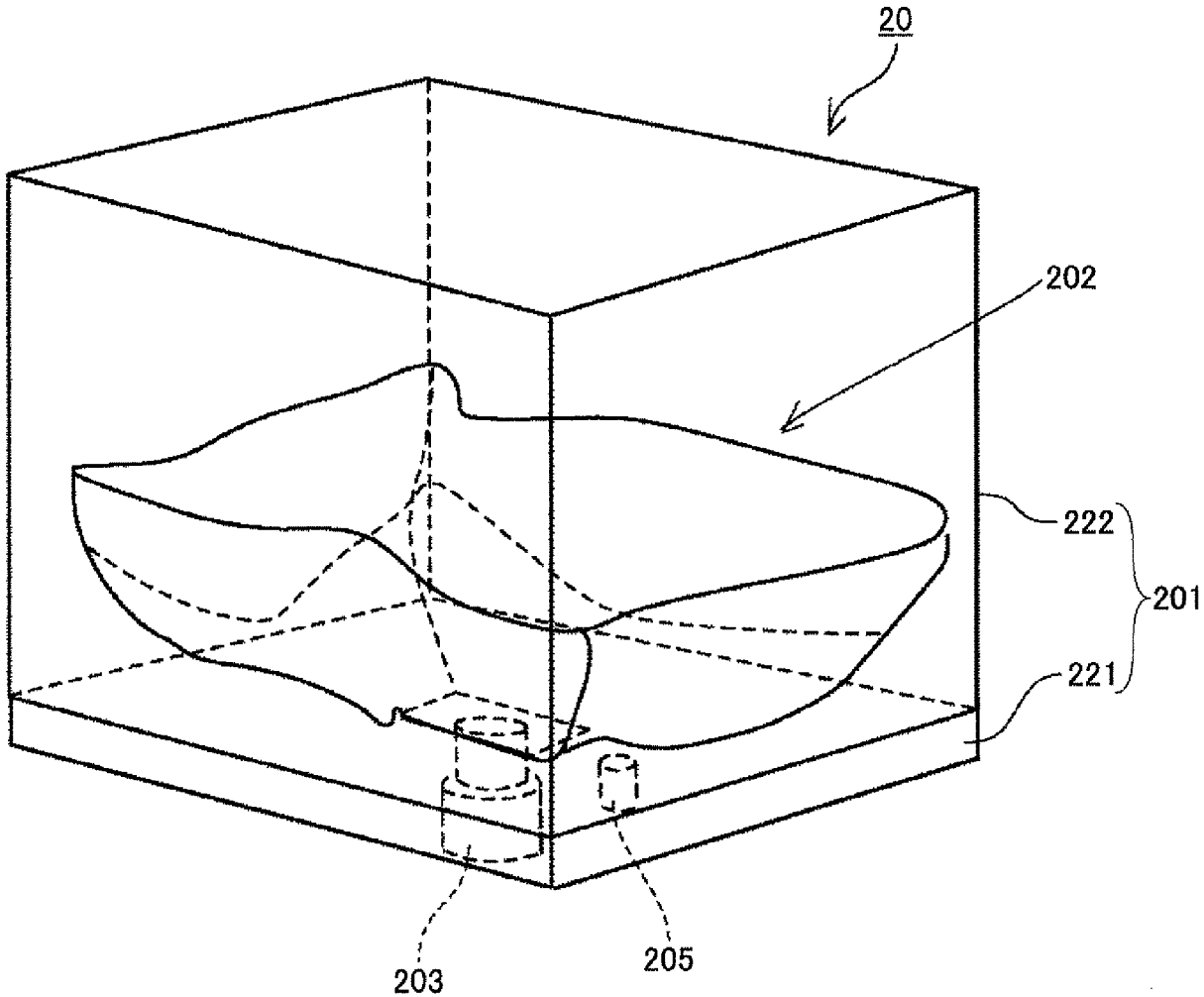
FIG. 8 is a perspective view for describing the function of an ink cartridge of a comparative example.

A comparative example is described with reference to FIG. 8.

In the comparative example, the plane part 211 that is on the side of the ink pack 202 opposite to the ink supply opening 203 is not fixed to the inner wall of the cartridge case 201. In this case, when the ink pack 202 made of a flexible film deflates as the ink is consumed, the shape of the ink pack 202 is not maintained in the cartridge case 201. Therefore, the respective ink packs 202 deflate in different manners.

Furthermore, the ink pack 202 does not deflate into a shape like a single film. Therefore, a large amount of ink may be left over in the ink pack 202, which means that the amount of usable ink is reduced (the amount of leftover ink is increased).

Meanwhile, with a configuration in which the side opposite to the liquid supply opening of the liquid containing member is fixed to the inner wall of the outer container, the liquid containing member deflates substantially evenly as the liquid is consumed, and the amount of leftover liquid can be reduced.

Figure 9:
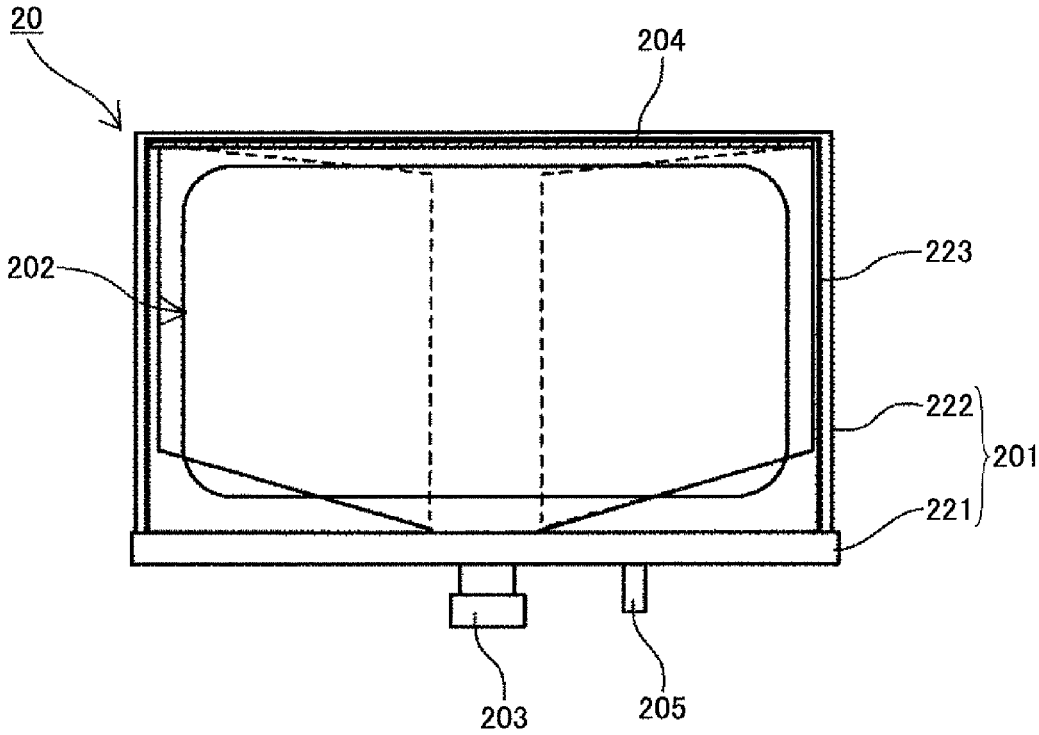
FIG. 9 is a front view of an ink cartridge according to a second embodiment of the present invention.
Figure 10:
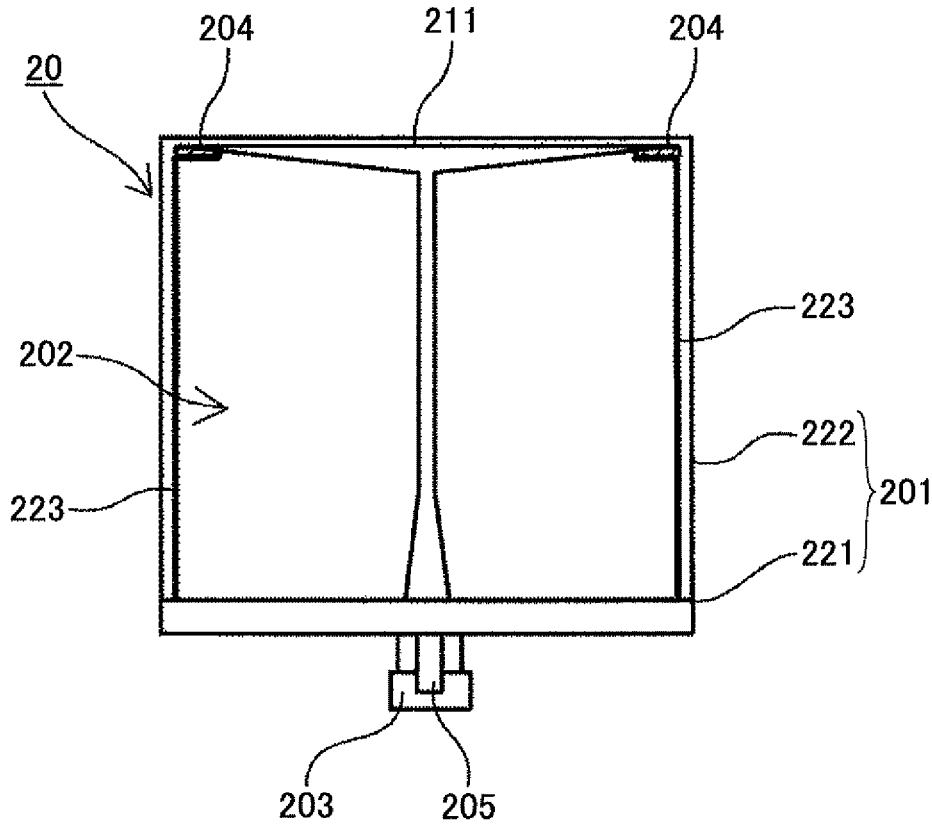
FIG. 10 is a side view of the ink cartridge according to the second embodiment of the present invention.

Next, a description is given of a second embodiment of the present invention with reference to FIGS. 9 and 10. FIG. 9 is a front view of an ink cartridge according to the second embodiment of the present invention. FIG. 10 is a side view of the ink cartridge according to the second embodiment of the present invention.

The cartridge case 201 includes the base member 221 and a box-shaped case member 222. The base member 221 is a plate member in which the ink supply opening 203 is formed. An ink pad pressing member 223 stands up from either edge of the base member 221. Two edges of the plane part 211 of the ink pack 202 are fixed to the ink pad pressing member 223 on the side opposite to the ink supply opening 203, by the fixing units 204.

The case member 222 is provided on the outside of the ink pad pressing member 223. Accordingly, the parts where the plane part 211 of the ink pack 202 is adhered to the ink pad pressing member 223 by two-sided adhesive tape (fixed by the fixing units), are sandwiched and pressed in between the ink pad pressing member 223 and the case member 222. Therefore, the two-sided tape acting as the fixing units 204 is prevented from peeling off.

The cartridge case 201 is assembled when the cartridge case 201 is not filled with ink. After the case member 222 and the base member 221 are heat-welded to each other, the cartridge case 201 is filled with ink.

Figure 11:
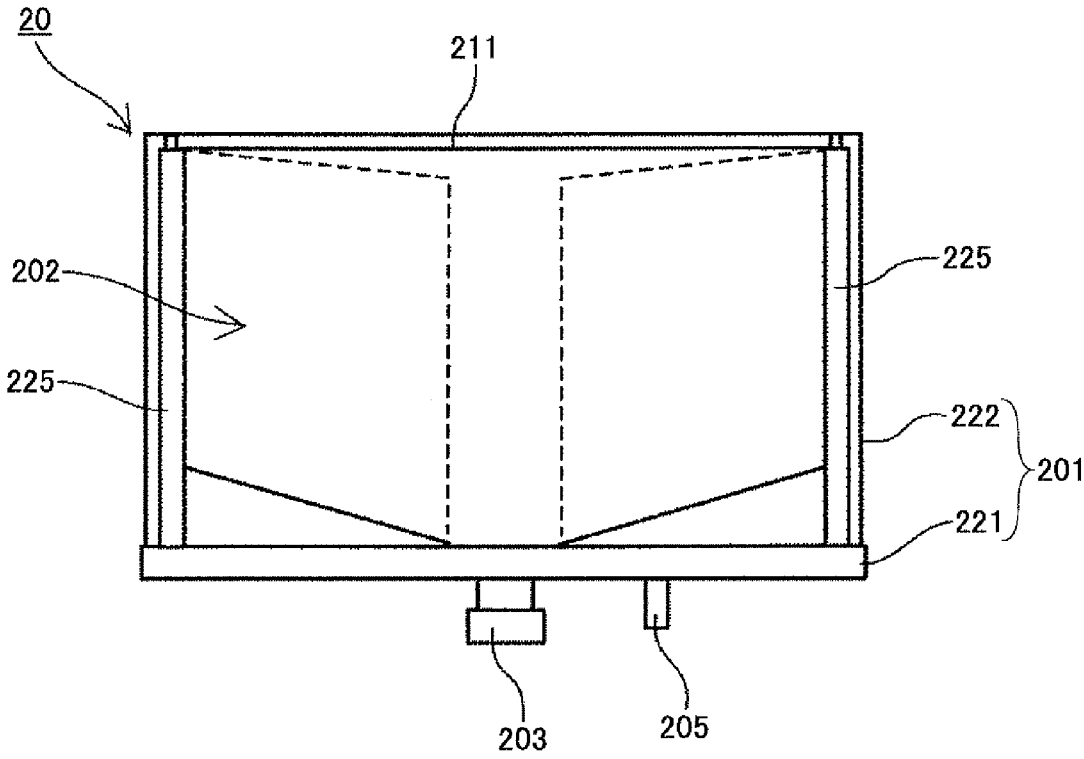
FIG. 11 is a front view of an ink cartridge according to a third embodiment of the present invention.
Figure 12:
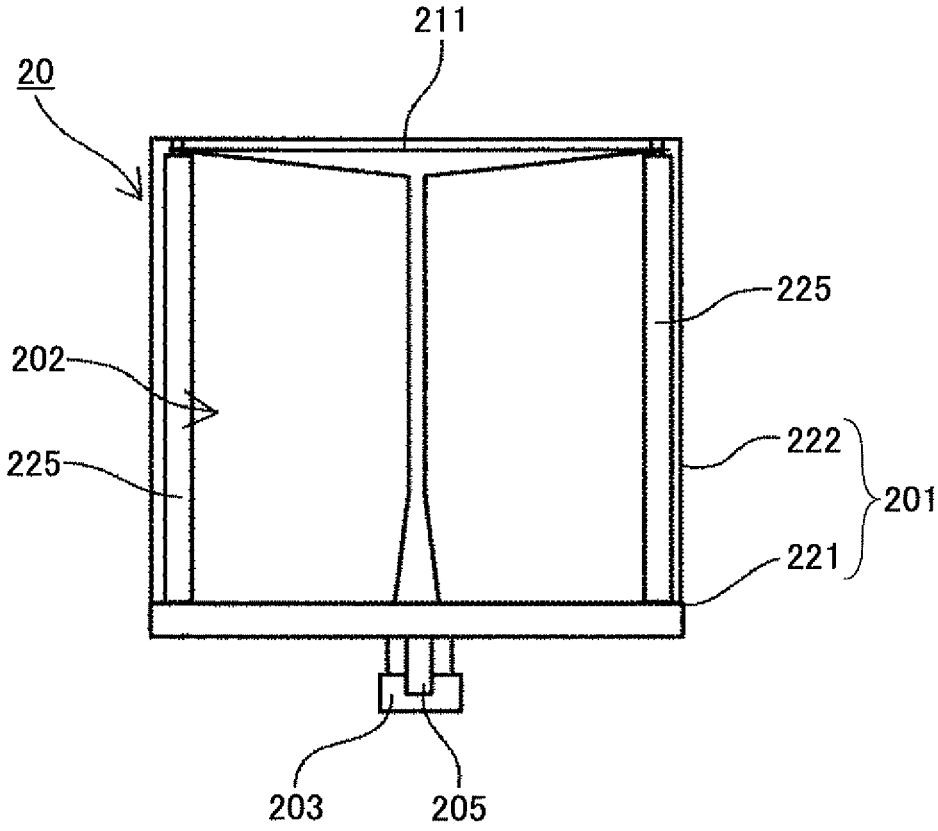
FIG. 12 is a side view of the ink cartridge according to the third embodiment of the present invention.
Figure 13:
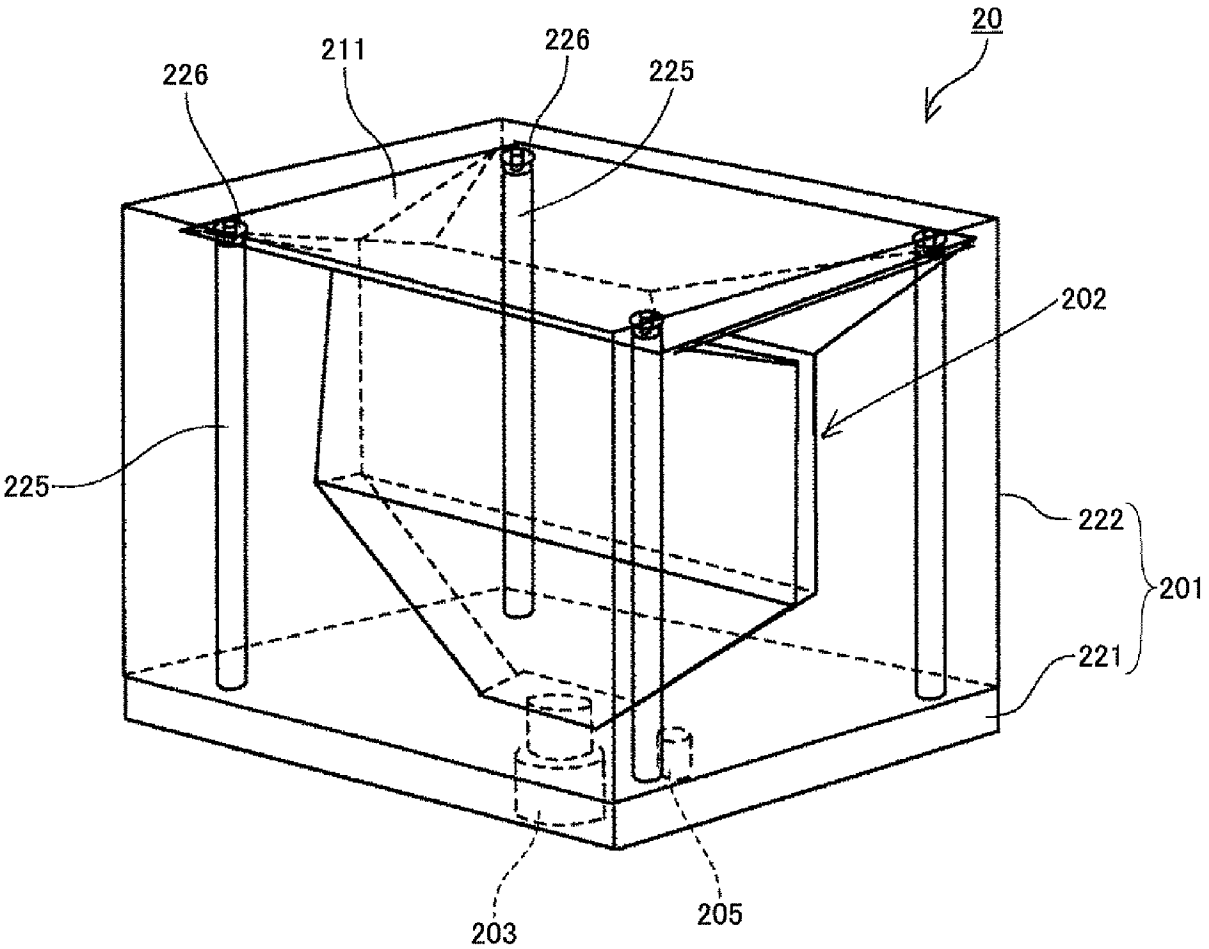
FIG. 13 is a perspective view of the ink cartridge according to the third embodiment of the present invention.

Next, a third embodiment of the present invention is described with reference to FIGS. 11 through 13. FIG. 11 is a front view of an ink cartridge according to the third embodiment of the present invention. FIG. 12 is a side view of the ink cartridge according to the third embodiment of the present invention. FIG. 13 is a perspective view of the ink cartridge according to the third embodiment of the present invention.

Instead of the ink pad pressing member 223 of the second embodiment, the third embodiment includes ink pack supporting rods 225. The ink pack supporting rods 225 stand up from the four corners of the base member 221. The tips of the ink pack supporting rods 225 are hooked to holes 226 that are formed in four corners of the ink pack 202. The tips of the ink pack supporting rods 225 are formed to pierce through the holes 226 of the ink pack 202 and be inserted in recessions formed on the inside of the case member 222, so that the ink pack supporting rods 225 are prevented from tilting.

Compared to the second embodiment in which two-sided adhesive tape is used as the fixing means, the third embodiment is advantageous in that there is no concern that the two-sided adhesive tape may peel off, and therefore the ink pack 202 can be fixed more reliably.

The four corners of the plane part 211 of the ink pack 202 are formed by welding together the films into a triangular shape, and therefore the ink does not leak even though the holes 226 are formed.

Figure 14:
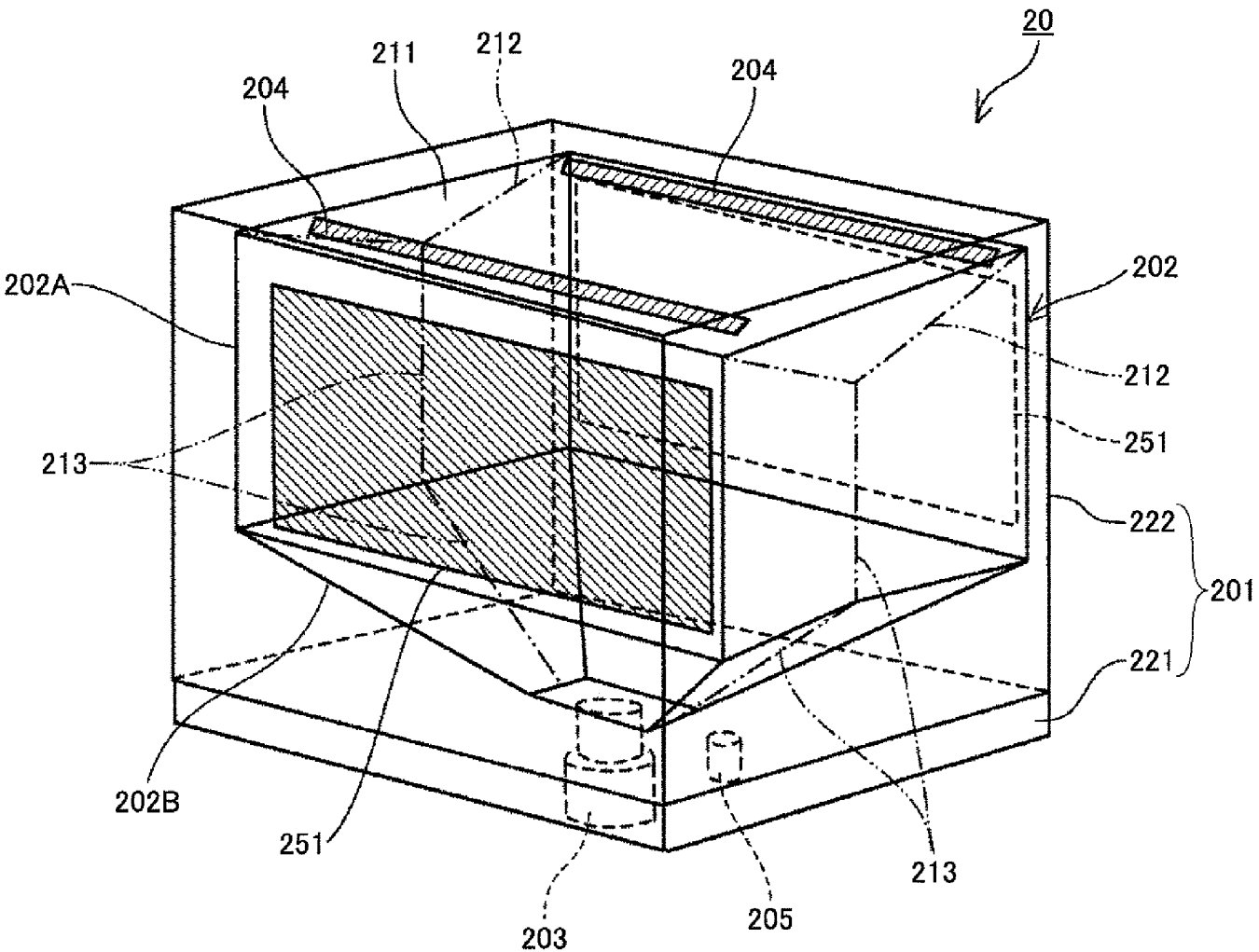
FIG. 14 is a perspective view of an ink cartridge according to the fourth embodiment of the present invention.

Next, a fourth embodiment of the present invention is described with reference to FIG. 14. FIG. 14 is a perspective view of the ink cartridge according to the fourth embodiment of the present invention.

In the fourth embodiment, a thick mylar sheet 251 is adhered to the side surface of the ink pack 202. By adhering the mylar sheet 251 to the side surface of the ink pack 202, wrinkles can be prevented from being formed in the film member of the ink pack 202 when the ink pack 202 deflates.

If wrinkles are formed in the film member of the ink pack 202, the ink enters the fine wrinkles, and consequently the amount of leftover ink may increase. This causes problems when the ink pack 202 is recycled. By preventing wrinkles from being performed, the amount of leftover ink can be reduced, and recycled usage of the ink pack 202 can be facilitated.

The shape of the liquid containing member is not limited to the above embodiments. The liquid containing member may have any shape as long as the side of the liquid containing member opposite to the ink supply opening is fixed to the outer container.

The present invention is not limited to the specific embodiments described herein, and variations and modifications may be made without departing from the scope of the present invention.

The present application is based on Japanese Priority Patent Application No. 2009-213784, filed on Sep. 15, 2009, the entire contents of which are hereby incorporated herein by reference.

What is claimed is:

1. A liquid container comprising:

a liquid containing member configured to contain liquid to be supplied to a recording head for jetting liquid droplets, the liquid containing member having flexibility; and an outer container configured to accommodate the liquid containing member, wherein the liquid containing member includes a rectangular parallelepiped part and a quadrangular pyramid part, the liquid containing member includes a liquid supply opening that is provided at a tip part of the quadrangular pyramid part, the liquid supply opening being directed downward when the liquid containing member is used, the liquid supply opening is fixed to one end part of the outer container, the quadrangular pyramid part is positioned below the rectangular parallelepiped part when the liquid containing member is used, a plane part provided on a side of the parallelepiped part of the liquid containing member opposite to the liquid supply opening is fixed to an inner surface of another end part of the outer container, and substantially a whole surface of the plane part is in contact with the inner surface of the another end part of the outer container when the liquid containing member is used, the plane part is positioned above the liquid supply opening when the liquid containing member is used, and two valley folds are provided on respective sides of liquid containing member, and the liquid containing member is folded according to the two valley folds.

2. The liquid container according to claim 1, wherein a plane part is formed on the side of the liquid containing member opposite to the liquid supply opening, and the plane part is fixed to the at least one inner surface of the outer container.

3. The liquid container according to claim 1, wherein the outer container includes a gas injection opening through which gas is injected into a space between plural of the inner surfaces of the outer container and outer surfaces of the liquid containing member.

4. An image forming apparatus comprising the liquid container according to claim 1.

* * * * *